US009303220B2

(12) United States Patent
Sadler et al.

(10) Patent No.: US 9,303,220 B2
(45) Date of Patent: Apr. 5, 2016

(54) PROCESS AND APPARATUS FOR PRODUCING DIESEL WITH HIGH CETANE

(71) Applicant: UOP LLC, Des Plaines, IL (US)

(72) Inventors: Clayton C. Sadler, Arlington Heights, IL (US); Vedula K. Murty, Willowbrook, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 14/014,550

(22) Filed: Aug. 30, 2013

(65) Prior Publication Data

US 2015/0064076 A1 Mar. 5, 2015

(51) Int. Cl.

| | |
|---|---|
| ***C10G 65/12*** | (2006.01) |
| ***C10G 49/00*** | (2006.01) |
| ***C10G 65/08*** | (2006.01) |

(52) U.S. Cl.

CPC ..... *C10G 65/12* (2013.01); *C10G 49/002* (2013.01); *C10G 65/08* (2013.01); *C10G 2400/04* (2013.01)

(58) Field of Classification Search

CPC ..... C10G 49/22; C10G 65/12
USPC ..... 422/609, 610, 630; 208/142
See application file for complete search history.

(56) References Cited

U.S. PATENT DOCUMENTS

| | | | | |
|---|---|---|---|---|
| 6,379,532 | B1 | 4/2002 | Hoehn et al. | |
| 7,005,057 | B1 | 2/2006 | Kalnes | |
| 7,622,034 | B1 | 11/2009 | Thakkar et al. | |
| 7,837,857 | B2 * | 11/2010 | Gautam et al. | 208/58 |
| 2011/0132803 | A1 | 6/2011 | Umansky et al. | |
| 2012/0004478 | A1 | 1/2012 | Umansky et al. | |
| 2012/0080288 | A1 * | 4/2012 | Petri et al. | 196/46 |
| 2012/0080355 | A1 | 4/2012 | Petri et al. | |
| 2012/0080356 | A1 | 4/2012 | Petri et al. | |
| 2013/0112596 | A1 | 5/2013 | Ramaseshan et al. | |

OTHER PUBLICATIONS

"Process That Aids Diesel Yield Available for Licensing", Oil & Gas Journal, Jan. 22, 2001, p. 75.
U.S. Appl. No. 14/014,524, filed Aug. 30, 2013.
Search Report dated Nov. 19, 2014 for corresponding PCT Appl. No. PCT/US2014/050887.

* cited by examiner

*Primary Examiner* — Lessanework Seifu
(74) *Attorney, Agent, or Firm* — James C. Paschall

(57) ABSTRACT

A process and apparatus is provided to produce desulfurized diesel at low pressure with high cetane rating. A hydrotreated stream is stripped and fed to a saturation reactor. The saturated stream is stripped again and fractionated to provide diesel product. Unconverted oil may be hydrocracked and stripped with the saturated product.

18 Claims, 1 Drawing Sheet

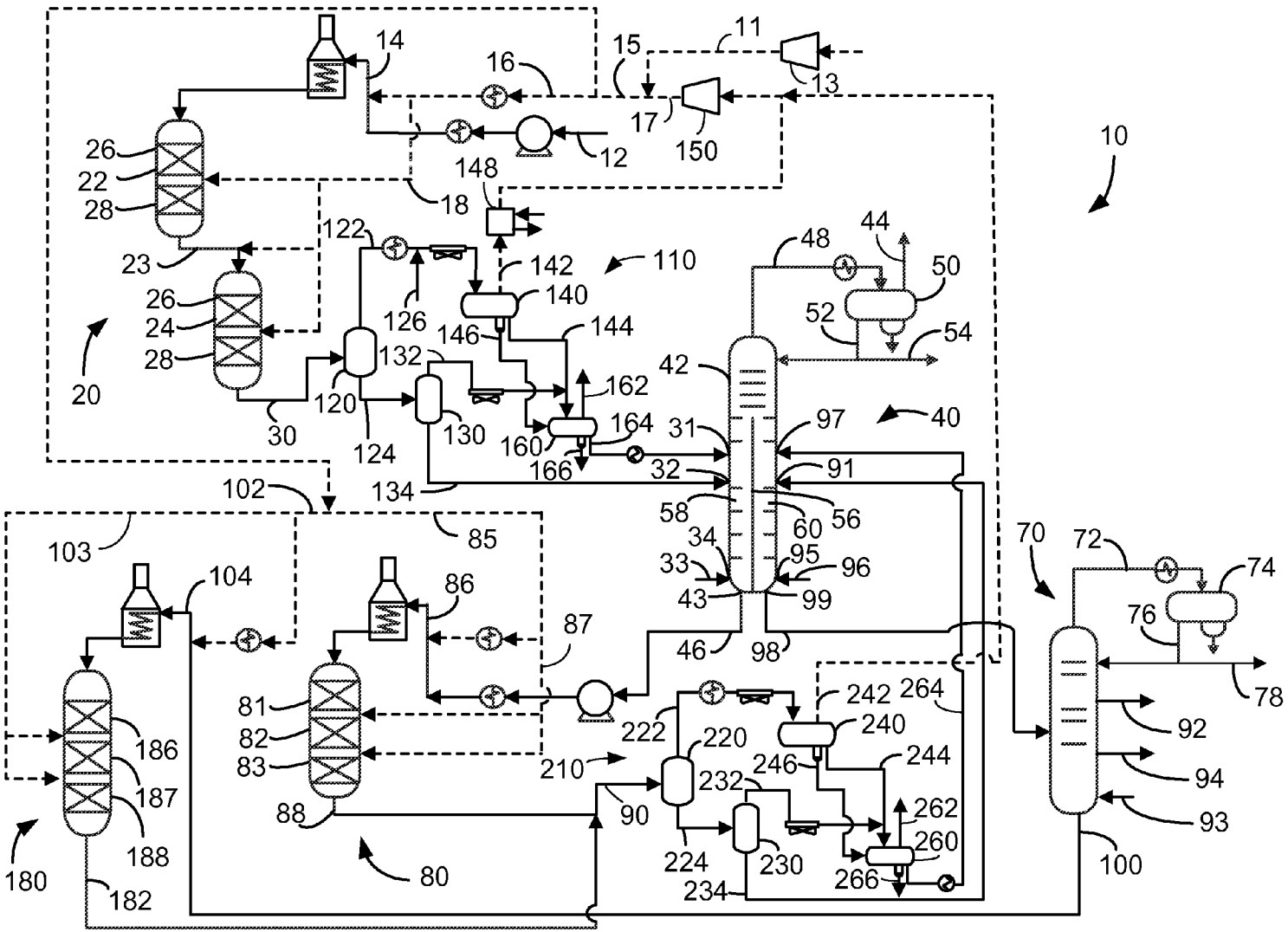
10
11
12
13
14
15
16
17
18
20
22
23
24
26
28
30
31
32
33
34
40
42
43
44
46
48
50
52
54
56
58
60
70
72
74
76
78
80
81
82
83
85
86
87
88
90
91
92
93
94
95
96
97
98
99
100
102
103
104
110
120
122
124
126
130
132
134
140
142
144
146
148
150
160
162
164
166
180
182
186
187
188
210
220
222
224
230
232
234
240
242
244
246
260
262
264
266

PROCESS AND APPARATUS FOR PRODUCING DIESEL WITH HIGH CETANE

FIELD

The field relates to a hydrocarbon conversion process and apparatus for the production of diesel.

BACKGROUND

It has been recognized that due to environmental concerns and newly enacted rules and regulations, saleable petroleum products must meet lower and lower limits on contaminates, such as sulfur and nitrogen. New regulations require essentially complete removal of sulfur from liquid hydrocarbons that are used in transportation fuels, such as gasoline and diesel. For example, ultra low sulfur diesel (ULSD) requires typically less than about 10 wppm sulfur.

Hydroprocessing is a process that contacts a selected feedstock and hydrogen-containing gas with suitable catalyst(s) in a reaction vessel under conditions of elevated temperature and pressure. Hydrocracking refers to a process in which hydrocarbons crack in the presence of hydrogen and catalyst to lower molecular weight hydrocarbons. Hydrocracking is a process used to crack hydrocarbon feeds such as vacuum gas oil (VGO) to diesel including kerosene and gasoline motor fuels. Hydrotreating is a type of hydroprocessing active for the removal of heteroatoms, such as sulfur and nitrogen, and saturating unsaturated compounds in the hydrocarbon feedstock.

Hydrotreating and hydrocracking converts sulfur on hydrocarbons to hydrogen sulfide and nitrogen on hydrocarbons to ammonia. Ammonia is a catalyst poison for hydroprocessing catalyst such as hydrocracking catalyst and saturation catalyst, particularly, noble metal saturation catalyst. Hydrogen sulfide and ammonia gases are stripped from liquid hydrocarbon streams to prepare them for further catalytic processing and to provide fuel products with low sulfur.

At higher pressures, such as 12.4 MPa (1800 psig) to 17.2 MPa (2500 psig), hydrotreating can also saturate aromatic compounds to increase the cetane number of diesel produced from a hydrocarbonaceous feed or to render it more susceptible to hydrocracking However, at lower pressures hydrotreating catalyst is less effective in saturating aromatics. High pressure processing is more expensive on capital and operational bases because it requires more robust metallurgy and compression systems.

There is a continuing need, therefore, for improved methods to produce diesel product with lower sulfur content and higher cetane value at lower cost.

SUMMARY

In a process embodiment, a process is provided to produce diesel comprising hydrotreating a hydrocarbonaceous feedstock with hydrogen in a hydrotreating reactor over a hydrotreating catalyst at conditions effective to produce a hydrotreated stream. Light gases are stripped from the hydrotreated stream to provide a stripped hydrotreated stream. Aromatics in the stripped hydrotreated stream are saturated to produce a saturated stream. Light gases are stripped from the saturated stream to provide a stripped saturated stream. Lastly, the stripped saturated stream is fractionated to produce a diesel stream.

In an apparatus embodiment, an apparatus is provided to produce diesel comprising a hydrotreating reactor for hydrotreating a hydrocarbonaceous feedstock to produce a hydrotreated stream. A first stripping section is in communication with the hydrotreating reactor for stripping light gases from the hydrotreated stream. A saturation reactor is in communication with the first stripping section for saturating aromatics. A second stripping section is in communication with the saturation reactor for stripping light gases from a saturated stream. Lastly, a fractionation column is in communication with the second stripping section.

Other embodiments encompass further details of the apparatus and process.

BRIEF DESCRIPTION OF THE DRAWING

The FIGURE is a simplified process flow diagram of an embodiment of the present invention.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

As used herein, the term "predominant" or "predominate" refers to greater than 50%, suitably greater than 75% and preferably greater than 90%.

The term "column" means a distillation column or columns for separating one or more components of different volatilities which may have a reboiler on its bottom and a condenser on its overhead. Unless otherwise indicated, each column includes a condenser on an overhead of the column to condense and reflux a portion of an overhead stream back to the top of the column and, at a bottom of the column, an inert gas injection or reboiler to vaporize and send a portion of a bottoms stream back to the bottom of the column. Feeds to the columns may be preheated. The top pressure is the absolute pressure of the overhead vapor at the outlet of the column. The bottom temperature is the liquid bottom outlet temperature.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass-% distilled is produced using fifteen theoretical plates in a column with a 5:1 reflux ratio.

As used herein, the term "diesel boiling range" means hydrocarbons in which at least 5 vol-% of the hydrocarbons boil at a temperature of no less than about 132° C. (270° F.) and no more than 95 vol-% of the hydrocarbons at a temperature of no more than about 399° C. (750° F.), preferably 377° C. (710° F.), using the True Boiling Point distillation method.

As used herein, the term "vacuum gas oil boiling range" means hydrocarbons in which at least 5 vol-% of the hydrocarbons boil at a temperature of no less than about 315° C. (600° F.) and no more than 95 vol-% of the hydrocarbons at a temperature of no more than about 566° C. (1050° F.) using the True Boiling Point distillation method.

The term "hydrotreat" generally refers to the saturation of double and triple bonds and removal of heteroatoms (oxygen, sulfur, nitrogen and metals) from heteroatomic compounds. Typically, to "hydrotreat" means to treat a hydrocarbon stream with hydrogen without making any substantial change to the carbon backbone of the molecules in the hydrocarbon stream with the corresponding production of water, hydrogen sulfide and ammonia from the heteroatoms in the heteroatomic compounds. Metals typically incorporate onto the catalyst when hydrotreated.

The term "hydrocrack" generally refers to the breaking down of high molecular weight material into lower molecular weight material in the presence of hydrogen gas and typically in the presence of a catalyst. For example, to "hydrocrack" means to split a hydrocarbon to form two hydrocarbon molecules.

DETAILED DESCRIPTION

Hydrotreating at lower pressures saves capital and operational costs but does not saturate aromatics sufficiently to boost cetane. We propose to provide a noble metal saturation catalyst to provide the cetane increase, but it must operate in an environment free of noble metal catalyst poisons. Consequently, the light materials are stripped downstream of a hydrotreating reactor to remove such poisons upstream of an aromatic saturation reactor. The saturated stream may also be stripped to remove hydrogen sulfide and ammonia upstream of a product fractionation column.

In one aspect, the processes and apparatuses described herein are particularly useful for hydroprocessing a hydrocarbonaceous feedstock containing diesel or VGO boiling range hydrocarbons. Illustrative hydrocarbon feedstocks include hydrocarbonaceous streams having components initial boiling points above about 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils, cat cracker distillates, and the like. These hydrocarbonaceous feed stocks may contain from about 0.1 to about 4 percent sulfur.

A preferred hydrocarbonaceous feedstock is a gas oil stream or other hydrocarbon fraction predominately boiling at a temperature above about 287° C. (550° F.) and below about 510° C. (950° F.).

Turning to the FIGURE, an exemplary integrated low-pressure hydroprocessing apparatus and process to provide low sulfur, high cetane diesel will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

The FIGURE shows a process and apparatus 10 for producing a low sulfur, high cetane diesel stream. A make-up hydrogen gas stream in line 11 from one or more make-up gas compressors 13 may be provided to a hydrogen line 15 along with a recycle gas stream in line 17 from a recycle gas compressor 150. The hydrogen line 15 may be split into three split lines 16, 85 and 102. A hydrocarbonaceous feedstock is introduced in a hydrocarbonaceous feed line 12 and is preheated and combined with a hydrogen gas stream in a first split line 16 to provide an admixture of the hydrocarbonaceous feedstock and hydrogen in line 14.

The admixture of the hydrocarbonaceous feedstock and hydrogen in line 14 is heated in a fired heater and fed to a first hydrotreating reactor 22 in a hydrotreating reaction zone 20. The first hydrotreating reactor 22 shown in the FIGURE may be accompanied by a second hydrotreating reactor 24 in the hydrotreating reaction zone 20. More hydrotreating reactors are contemplated. Each of the hydrotreating reactors 22, 24 may have just one bed of hydrotreating catalyst 26 or have multiple hydrotreating catalyst beds 26, 28. A hydrogen quench stream 18 may bypass heaters and be divided up and fed to the effluent from a hydrotreating catalyst bed 26, 28 or a hydrotreating reactor 22, 24 to cool the hot hydrotreated effluent. A first hydrotreated stream exits the first hydrotreating reactor 20 in line 23. One or both of the hydrotreating reactors 22, 24 in the hydrotreating reaction zone 20 may be operated in a continuous liquid or gas phase. A hydrotreated stream 30 leaves the second hydrotreating reactor 24 and the hydrotreating zone 20 in line 30.

In hydrotreating, hydrogen gas is contacted with hydrocarbonaceous feedstock in the presence of suitable hydrotreating catalysts which are primarily active for the removal of heteroatoms, such as sulfur and nitrogen from the hydrocarbon feedstock and saturation of unsaturated hydrocarbons. In the hydrotreating reactor(s) 22, 24, conditions are effective for hydrotreating reactions to predominate over any other reaction to produce a hydrotreated stream in line 30. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

Suitable hydrotreating reaction conditions include a temperature from about 371° C. (700° F.) to about 482° C. (900° F.), preferably from about 388° C. (730° F.) to about 460° C. (860° F.) and a liquid hourly space velocity of the fresh hydrocarbonaceous feedstock from about 0.1 $hr^{-1}$ to about 10 $hr^{-1}$ with a hydrotreating catalyst or a combination of hydrotreating catalysts. In an aspect, the hydrotreating reaction zone is operated at a lower pressure than typical hydrotreaters such as a pressure from about 3.5 MPa (gauge) (500 psig) to about 11.7 MPa (gauge) (1700 psig), preferably from about 9.0 MPa (gauge) (1300 psig) to about 11.0 MPa (gauge) (1600 psig). In an aspect, hydrotreated effluent having a lower organic sulfur and nitrogen concentration and an improved cetane number than that of the hydrocarbonaceous feedstock exits the hydrotreating reaction zone 20 in line 30 and enters a hydrotreating separation zone 110. However, at the lower pressure in the hydrotreating reactor(s) 22, 24, saturation of olefins occurs, but saturation of aromatic rings is limited. Consequently at the lower pressure of the apparatus and process, cetane uplift is not as great as at typically higher pressures.

The hydrotreated stream in line 30 may be processed through a series of vessels in the hydrotreating separation zone 110 to separate and flash off hydrogen and lighter gases to remove hydrogen sulfide and ammonia from the hydrotreated stream and to provide a recycle hydrogen stream in line 142. Hydrogen sulfide and ammonia can poison downstream hydroprocessing catalyst, particularly aromatic saturation catalyst.

The hydrotreated stream in line 30 may be cooled before entering a hydrotreating hot separator 120. In the hydrotreating hot separator 120, the hydrotreated stream is separated into a hot vaporous hydrotreated stream comprising hydrogen in a hot separator overhead line 122 and a hot liquid hydrotreated stream in a hot separator bottoms line 124. The hot liquid hydrotreated stream in the hot separator bottoms line 124 may be stripped in the stripping column 42 of the stripping zone 40 or be further flashed. The hydrotreating hot separator 120 operates at about 177° C. (350° F.) to about 371° C. (700° F.) and the pressure of the hydrotreating reaction zone 20. The vaporous hydrotreated stream in the hot separator overhead line 122 may be joined by a wash water stream in line 126 to wash out ammonium hydrosulfides, cooled and enter the cold separator 140.

The hot liquid hydrotreated stream in line 124 may be flashed in a hydrotreating hot flash drum 130 to provide a hot vaporous flash stream in a hot flash overhead line 132 and a hot liquid flash hydrotreated stream in a hot flash bottoms line 134. The hydrotreating hot flash drum 130 may be operated at the same temperature as the hydrotreating hot separator 120 but at a lower pressure of between about 1.4 MPa (gauge) (200 psig) and about 3.1 MPa (gauge) (450 psig). The hot liquid flash hydrotreated stream in the hot flash bottoms line 134 may be stripped in the stripping column 42 of the stripping zone 40.

A hydrotreating cold separator 140 is in downstream communication with the hydrotreating hot separator overhead line 122 and the hydrotreating reactor(s) 22, 24 of the hydrotreating reaction zone 20. In an aspect, the hydrotreating hot separator 120 and the hydrotreating hot flash drum 130 can be dispensed with and the cold hydrotreating separator 140 will be in direct, downstream communication with the hydrotreating reactor(s) 22, 24 and receive the hydrotreating stream in line 30, directly. In the hydrotreating cold separator 140, the hot vaporous hydrotreated stream is separated into a cold vaporous stream comprising hydrogen in a cold separator overhead line 142 and a cold liquid hydrotreated stream in a cold separator bottoms line 144. The hydrotreating cold separator also has a boot for collecting an aqueous phase in line 146. The cold vaporous hydrotreated stream in line 142 may be scrubbed in a scrubber 148 to remove hydrogen sulfide by amine absorption and recycled via a recycle gas compressor 150 to the hydrogen supply line 15. The hydrotreating cold separator may be operated at about 15° C. (60° F.), preferably about 46° C. (115° F.), to about 63° C. (145° F.) and just below the pressure of the hydrotreating reaction zone 20 accounting for pressure drop in the lines therebetween to keep hydrogen and light gases such as hydrogen sulfide and ammonia in the overhead and normally liquid hydrocarbons in the bottoms. The hydrotreating cold separator 140 is operated at a temperature below the temperature at which the hydrotreating hot separator 120 is operated. The cold liquid hydrotreated stream in the cold separator bottoms line 124 may be stripped in the stripping column 42 of the stripping zone 40 or be further flashed.

In an aspect, the cold liquid hydrotreated stream in the hydrotreating cold separator bottoms line 144 may be flashed in the hydrotreating cold flash drum 160 which may be operated at the same temperature as the hydrotreating cold separator 140 but at a lower pressure of between about 1.4 MPa (200 psig) and about 3.5 MPa (gauge) (500 psig) to provide a cold liquid flash hydrotreated stream in a cold flash bottoms line 164. In an aspect, the hot vaporous flash stream in the hot flash overhead line 132 may join the cold liquid hydrotreated stream in the cold separator bottoms line 144 and be flashed in the hydrotreating cold flash drum 160 together. The aqueous stream in line 146 from the boot of the hydrotreating cold separator may directed to the hydrotreating cold flash drum 160. A flash aqueous stream comprising sour water is removed from a boot in the hydrotreating cold flash drum 160 in line 166. A cold vaporous flash stream is removed in the cold flash overhead line 162. The cold liquid flash hydrotreated stream in cold flash bottoms line 164 may be stripped in the stripping column 42 of the stripping zone 40.

Although hydrogen sulfide and ammonia in the gas phase are removed from the hydrotreated streams, they remain absorbed in the hydrocarbon liquid phase. Still further removal of these poisons from the hydrotreated stream by stripping will be necessary for the hydrotreated stream to be suitable for contact with aromatic saturation catalyst.

The stripping zone 40 comprises a stripping column 42 in downstream communication with the hydrotreating reaction zone 20. The stripping column 42 strips light gases from the hydrotreated stream to provide a stripped hydrotreated stream in a stripper bottoms line 46. In an aspect, the stripping column 42 strips the cold liquid flash hydrotreated stream in cold flash bottoms line 164 entering through a first hydrotreated stream inlet 31. Alternatively, the stripping column strips cold liquid hydrotreated stream in the cold separator bottoms line 144 which may enter through the first hydrotreated stream inlet 31 (not shown). Additionally or alternatively, the stripping column strips the hot liquid flash hydrotreated stream in hot flash bottoms line 134 entering through a second hydrotreated stream inlet 32. Alternatively, the stripping column strips hot liquid hydrotreated stream in the hot separator bottoms line 124 which may enter through the second hydrotreated stream inlet 32 (not shown).

The stripping column 42 strips the hydrotreated stream with stripping gas to provide a light gas stream in the off-gas line 44 and a stripped hydrotreated stream in a bottoms line 46. In an embodiment, an overhead line 48 removes vapor from a top of the stripping column 42. The vapor from overhead line 48 is condensed and deposited in a receiver 50. The off-gas line 44 removes light gas from a top of the receiver 50, and unstabilized naphtha from a bottom of the receiver in line 52. An aqueous phase may be removed from a boot in the receiver 50. At least a portion of the unstabilized naphtha may be refluxed to the fractionation column 42, while unstabilized naphtha may be recovered in line 54 for further processing. The light gas can be scrubbed to remove gases from the fuel gas for further recovery and use which is not shown. The top pressure in the stripping column 42 ranges between about 621 kPa (gauge) (90 psig) and about 1034 kPa (gauge) (150 psig) and the bottom temperature in the stripping column 42 ranges between about 210° and about 307° C. if the feed in line 12 is predominantly a VGO boiling range feed. Other bottom temperatures may be suitable for different feeds in line 12.

In an aspect, stripping column 42 may be a dividing wall stripping column 42. A dividing wall 56 may divide the dividing wall stripping column 42 into separate sections, a first stripping section 58 on a first side and a second stripping section 60 on a second side of the dividing wall. In this aspect, the hydrotreated stream comprising one of the cold liquid hydrotreated stream and the cold liquid flash hydrotreated stream and perhaps one of the hot liquid hydrotreated stream and the hot liquid flash saturated stream is fed is fed to the first stripping section 58 of the dividing wall stripping column 42 through a first hydrotreated stream inlet 31, so the first stripping section 58 is in downstream communication with the hydrotreating reactor 22 or hydrotreating reactor(s) 22, 24 in the hydrotreating reaction zone 20. The stripped hydrotreated stream is recovered at a bottom of the first stripping section 58 of the dividing wall stripping column 42 in the first bottoms line 46. In an aspect, the dividing wall 56 extends to the bottom of the dividing wall fractionation column 42 and is attached and sealed to a bottom and inner walls of the dividing wall column to prevent fluid communication between the first stripping section 58 on the first side and the second stripping section 60 on the second side at any location below a top of the dividing wall 56. The cold liquid flash hydrotreated stream or the cold liquid hydrotreated stream is fed to the first side 58 at the first hydrotreated stream inlet 31 located below a top of the dividing wall 56. Additionally, the hot liquid flash hydrotreated stream or the hot liquid hydrotreated stream may be fed to the first side 58 at the second hydrotreated stream inlet 32 located below a top of the dividing wall 56.

A top of the dividing wall 56 may be spaced from a top of the stripping column 42, so gases in the overhead of the stripping column 42 may communicate from a first stripping section 58 with the second stripping section 60 and vice versa. A single overhead line 48 may remove vapor from the first stripping section 58 and the second stripping section 60 of the stripping column 42. The first hydrotreated stream inlet 31 and the second hydrotreated stream inlet 32 to the first stripping section 58 are at an elevation lower than a top of the dividing wall 56. The first hydrotreated stream inlet 31 is at a higher elevation than the second hydrotreated stream inlet 32.

A first stripping stream of inert gas in a first stripping line 33 comprising an inert gas is injected into a bottom of the first stripping section 58 through a first stripping stream inlet 34 to strip light gases from the down-flowing liquid hydrotreated stream. The inert gas may be hydrogen or steam, but steam is preferred. The first hydrotreated stream inlet 31 and the second hydrotreated stream inlet 32 and a first stripping stream inlet 34 are in the first stripping section 58. A stripped hydrotreated stream may exit the first stripping section 58 through a first outlet 43 in the first bottoms line 46, which is located below the first hydrotreated stream inlet 31 and the second hydrotreated stream inlet 32 to the first stripping section 58 at a bottom of the stripping column 42. The bottom temperature in the first stripping section 58 of the dividing wall fractionation column 42 ranges between about 285° and about 307° C. if the feed in line 12 is predominantly a VGO boiling range feed.

At the lower pressures in the hydrotreating reactor, the cetane value of diesel in the hydrotreated stream in line 30 and the stripped hydrotreated stream in bottoms line 46 may not be sufficiently high. Therefore, to boost the cetane value, the stripped hydrotreated stream must be further saturated. Essentially all of the ammonia and hydrogen sulfide are removed as off-gas from the stripping column 42, so the stripped hydrotreated feed in the first bottoms line 46 can be saturated in the saturation reactor 80 without poisoning the noble metal catalyst that is most effective for saturating aromatic compounds.

The apparatus and process 10 comprises a saturation reactor 80 in downstream communication with the first stripping section 58 of the stripping column 42. A second hydrogen split line 85 provides a saturation hydrogen stream to the stripped hydrotreated stream in the bottoms line 46 to present a saturation feed stream in saturation feed line 86. The saturation feed stream may be heated in a fired heater and fed to the saturation reactor 80. In the saturation reactor, the aromatics in the stripped hydrotreated stream are saturated over a saturation catalyst at saturation conditions to produce cycloaliphatics thereby increasing the cetane rating of the diesel. Olefins are also saturated and other hydrotreating reactions occur in the saturation reactor 80. In the saturation reactor, hydrotreating reactions predominate over other reactions.

The saturation reactor 80 in the FIGURE is shown to comprise one reactor vessel and three catalyst beds 81, 82 and 83. More reactor vessels and more or less catalyst beds may be used as the saturation reactor 80. A hydrogen quench stream 87 may bypass heaters and be divided up and fed to the effluent from a saturation catalyst bed 81, 82, 83 or the saturation reactor 80 to cool the hot saturation effluent.

Suitable saturation catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. A preferred saturation catalyst is a noble metal catalyst for which the noble metal is selected from palladium and platinum. It is within the scope of the present invention that more than one type of saturation catalyst be used in the same saturation reactor 80. The noble metal is typically present in an amount ranging from 0.1 to 5 wt-%, preferably from 0.2 to 1.0 wt-% in the saturation catalyst.

Preferred saturation reaction conditions include a temperature from 315° C. (600° F.) to 427° C. (800° F.) and preferably 343° C. (650° F.) to 377° C. (710° F.). Saturation reactor pressure is usually greater, but in the low pressure environment of the apparatus and process 10, the pressure in the saturation reactor may be from about 6.9 MPa (gauge) (1000 psig) to about 10.3 MPa (gauge) (1500 psig), preferably from about 7.6 MPa (1100 psig) to about 9.7 MPa (1400 psig), a liquid hourly space velocity of the fresh hydrocarbonaceous feedstock from about 0.5 $hr^{-1}$ to about 4 $hr^{-1}$, preferably from about 1.5 to about 3.5 $hr^{-1}$, and a hydrogen rate of about 168 $Nm^3/m^3$ oil (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl).

Before describing the recovery of the saturation stream, description of the hydrocracking aspect of the process and apparatus will be described because the saturation stream and the hydrocracking stream may be processed together.

A hydrocarbon stream which may be a saturated unconverted oil stream in a fractionator bottoms line 100 may be fed to the hydrocracking reactor 180. It should be understood that the hydrocracking reactor 180 is optional.

In an embodiment, the hydrocracking reactor 180 is in downstream communication with the saturation reactor 80, the second stripping section 60 of the stripping column 42 and the fractionation column 70. The hydrocarbon stream in the fractionator bottoms line 100 is preheated and combined with a hydrogen gas stream from the third split line 102. The hydrogen gas stream from line 102 is admixed with the hydrocarbon stream in the fractionator bottoms line 100 to provide an admixture of the hydrocarbon stream and hydrogen in line 104.

The admixed stream in line 104 is heated in a fired heater and fed to the hydrocracking reactor 180. The hydrocracking reactor 180 may include more than one reactor vessel. The hydrocracking reactor 180 shown in the FIGURE has only one reactor vessel. More hydrocracking reactor vessels are contemplated. The hydrocracking reactor 180 may have just one bed 186 of hydrocracking catalyst or have multiple hydrocracking catalyst beds 186, 187 and 188. A hydrocracked stream exits the hydrocracking reactor 180 in line 182. A hydrogen quench stream 103 may bypass heaters and be divided up and fed to the effluent from a hydrocracking catalyst bed 186, 187, 188 or hydrocracking reactor 180 to cool the hot hydrocracked effluent.

In an aspect, the hydrocracked stream in line 182 may join the saturation stream in line 88 and be jointly processed together in a saturation separation zone 210 before entering the second stripping section 60 of the stripping column 42 in the stripping zone 40 together. The second stripping section 60 is in downstream communication with the saturation reactor 80 and the hydrocracking reactor 180.

In the hydrocracking reactor 180, the hydrocarbon stream in line 104 is hydrocracked with hydrogen over a hydrocracking catalyst at conditions effective to produce a hydrocracked stream in line 182. Hydrocracking reactions involve the cracking of carbon-carbon bonds. In the hydrocracking reactor 180, hydrocracking reactions predominate over other reactions.

In one aspect, for example, when a balance of middle distillate and gasoline is preferred in the converted product, mild hydrocracking may be performed in the hydrocracking reactor 180 with hydrocracking catalysts that utilize amorphous silica-alumina bases or low-level zeolite bases combined with one or more Group VIII or Group VIB metal hydrogenating components. In another aspect, when middle distillate is significantly preferred in the converted product over gasoline production, partial or full hydrocracking may be performed in the hydrocracking reactor 180 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The naturally occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt-%. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 343° C. (650° F.) to about 427° C. (800° F.), preferably 379° C. (715° F.) to about 399° C. (750° F.). If mild hydrocracking is desired, conditions may include a temperature from about 315° C. (600° F.) to about 441° C. (825° F.). The pressure in the hydrocracking reactor may be from about 6.9 MPa (gauge) (1000 psig) to about 10.3 MPa (gauge) (1500 psig), preferably from about 7.6 MPa (1100 psig) to about 9.7 MPa (1400 psig). The liquid hourly space velocity (LHSV) in the hydrocracking reactor may be from about 0.5 to about 5.0 $hr^{-1}$ and a hydrogen rate of about 421 $Nm^3/m^3$ oil (2,500 scf/bbl) to about 2,527 $Nm^3/m^3$ oil (15,000 scf/bbl.)

The saturated stream in line 88 may be joined by the hydrocracked stream in line 110 and may be cooled before entering the saturation separation zone 210 as a joint stream in joint line 90. It should be understood that the saturated stream in line 88 may be separated in the saturation separation zone and further processed by itself or jointly with the hydrocracked stream in line 182. For purposes of description, the processing of the saturated stream will be described as if it is jointly processed with the hydrocracked stream but processing of the saturated stream without the hydrocracked stream is contemplated.

The joint stream including the saturated stream and the hydrocracked stream may enter a saturation hot separator 220. In the saturation hot separator 220 the joint stream is separated into a hot vaporous saturated stream comprising hydrogen in a hot separator overhead line 222 and a hot liquid saturated stream in a hot separator bottoms line 224. The saturation hot separator 220 operates at about 177° C. (350° F.) to about 371° C. (700° F.) and at the same pressure as the saturation reactor 80 and/or the hydrocracking reactor 180. The vaporous saturated stream in the hot separator overhead line 222 may enter a saturation cold separator 240. The hot liquid saturated stream in the hot separator bottoms line 224 may be stripped in the stripping zone 40 or be further flashed.

The hot liquid saturated stream in line 224 may be flashed in a saturation hot flash drum 230 to provide a hot vaporous flash saturated stream in a hot flash overhead line 232 and a hot liquid flash saturated stream in a hot flash bottoms line 234. The saturation hot flash drum 230 may be operated at the same temperature as the saturation hot separator 220 but at a lower pressure of between about 1.4 MPa (gauge) (200 psig) and about 3.5 MPa (gauge) (500 psig). The hot liquid flash saturated stream in the hot flash bottoms saturated stream may be stripped in the stripping column 42.

The saturation cold separator 240 may be in downstream communication with the saturation hot separator overhead line 222 and the saturation reactor 80 and/or the hydrocracking reactor 180. In an aspect, the saturation hot separator 220 and the saturation hot flash drum 230 can be dispensed with and the cold saturation separator 240 will be in direct, downstream communication with the saturation reactor 80 and perhaps the hydrocracking reactor 180 and receive the saturation stream in line 88 or in the joint stream 90, directly. In the saturation cold separator 240, the hot vaporous saturated stream is separated into a cold vaporous saturated stream comprising hydrogen in a cold separator overhead line 242 and a cold liquid saturated stream in a cold separator bottoms line 244. The saturation cold separator also has a boot for collecting an aqueous phase in line 246. The cold vaporous saturated stream in line 242 may be recycled via a recycle gas compressor 150 to the hydrogen line 15. The cold vaporous saturated stream in line 242 may bypass the scrubber 148 in route to the recycle gas compressor 150 because the saturation feed in the first bottoms line 46 to the saturation reactor 80 and the hydrocarbon feed in the fractionation bottoms line 100 to the hydrocracking reactor 180 have already been stripped to remove most of the sulfur and nitrogen that could generate hydrogen sulfide and ammonia. The saturation cold separator may be operated at about 15° C. (60° F.), preferably about 46° C. (115° F.), to about 63° C. (145° F.) and just below the pressure of the saturation reactor 80 and/or the hydrocracking reactor 180 accounting for pressure drop in the lines therebetween to keep hydrogen and light gases in the overhead and normally liquid hydrocarbons in the bottoms. The saturation cold separator 240 is operated at a temperature below the temperature at which the saturation hot separator 220 is operated. The cold liquid saturated stream in the cold separator bottoms line 244 may be stripped in the stripping zone 40 or be further flashed.

In an aspect, the cold liquid saturated stream in the cold separator bottoms line 244 may be flashed in the saturation cold flash drum 260 which may be operated at the same temperature as the saturation cold separator 240 but at a lower pressure of between about 1.4 MPa (200 psig) and about 3.5 MPa (gauge) (500 psig) to provide a cold liquid flash saturated stream in a cold flash bottoms line 264. In an aspect, the hot vaporous flash saturated stream in the hot flash overhead line 232 may join the cold liquid saturated stream in the cold separator bottoms line 244 and be flashed in the saturation cold flash drum 260 together. The aqueous stream in line 246 from the boot of the saturation cold separator may directed to the saturation cold flash drum 260. A flash aqueous stream comprising sour water is removed from a boot of the saturation cold flash drum 260 in line 266. A cold vaporous flash saturated stream is removed in the cold flash overhead line 262. The cold liquid flash saturated stream in cold flash bottoms line 264 may be stripped in the stripping zone 40.

The stripping column 42 in the stripping zone 40 strips light gases from the saturated stream to provide a stripped saturated stream. The stripping column 42 may also strip light gases and from the hydrocracked stream to produce a stripped hydrocracked stream. In an aspect, the stripping column strips light gases from the hydrocracked stream and the saturated stream together to produce a joint stripped stream comprising the stripped saturated stream and the stripped hydrocracked stream in a second bottoms line 98.

In an aspect, the stripping column 42 strips the cold liquid flash saturated stream in cold flash bottoms line 264 entering through a first saturation stream inlet 97. Alternatively, the stripping column strips cold liquid saturated stream in the cold separator bottoms line 244 which may enter through the first saturation stream inlet 97 (not shown). Additionally or alternatively, the stripping column strips the hot liquid flash saturated stream in hot flash bottoms line 234 entering through second saturation stream inlet 91. Alternatively, the stripping column strips hot liquid saturated stream in the hot separator bottoms line 224 which may enter through the second saturation stream inlet 91 (not shown). The stripping column 42 strips the hydrotreated stream with stripping gas to provide a light gas stream in the off-gas line 44 and a stripped saturated stream in a bottoms line 98. In an aspect, the stripping column 42 is a dividing wall column, and the saturated stream comprising one of the cold liquid saturated stream and the cold liquid flash saturated stream and perhaps one of the hot liquid saturated stream and the hot liquid flash saturated stream are fed to the second stripping section 60 on a second side of the dividing wall 56 in the dividing wall column 42, so the second side of the dividing wall column is in downstream communication with the saturation reactor 80. The saturated stream may include a hydrocracked stream in an aspect. Additionally, the second stripping section 60 may be in downstream communication with the hydrocracking reactor 180, so the saturated stream is fed to the second stripping section 60 on a second side of the dividing wall 56 in the dividing wall column 42 jointly with the hydrocracked stream. The first stripping section 58 and said second stripping section 60 are in a single stripping column 42 with the dividing wall 56 in between. In other words, the first stripping section 58 is separated from the second stripping section 60 by the dividing wall 56 in the stripping column 42. The dividing wall 56 has a lower end attached to a bottom of the stripping column 42, and the dividing wall has an upper end that is spaced apart from a top of the stripping column. Light gases may be stripped from the hydrotreated stream and the saturated stream and perhaps the hydrocracked stream in the single stripping column 42.

In an aspect, the dividing wall 56 extends to the bottom of the dividing wall fractionation column 42 and is sealed to the bottom and sides of the dividing wall column to prevent communication between the first section 58 and the second stripping section 60 at any location below a top of the dividing wall 56. The dividing wall 56 isolates liquid in the hydrotreated stream entering through the first hydrotreating inlet 31 and/or the second hydrotreating inlet 32 from liquid in the saturated stream an perhaps the hydrocracked stream entering through the first saturation stream inlet 97 and/or the second saturation stream inlet 91 while stripping light gases from the hydrotreated stream and the saturated stream. The first saturation stream inlet 97 and the second saturation stream inlet 91 to the second stripping section 60 are at an elevation lower than a top of the dividing wall 56. The first saturation stream inlet 97 is at a higher elevation than the second saturation stream inlet 91.

A second stripping stream of inert gas in a second stripping line 96 is injected through a second stripping stream inlet 95 into a bottom of the second stripping section 60 to strip gaseous components from the down flowing saturated stream. The second stripping stream does not communicate with the first stripping stream 33 fed to the first stripping section 58 before the second stripping stream strips the saturated stream. The first saturated stream inlet 97 and the second saturated stream inlet 91 and a second stripping stream inlet 95 are in the second stripping section 60. The saturated stream is fed to the second stripping section 60 below a top of the dividing wall 56. The hydrocracked stream may also be fed jointly with the saturated stream to the second stripping section 60 below a top of the dividing wall 56.

The inert gas may be hydrogen or steam, but steam is preferred. The bottom temperature in the second stripping section 60 of the dividing wall fractionation column 42 ranges between about 200 and about 250° C. A stripped saturate stream is recovered from a second bottoms line 98 exiting through a second bottoms outlet 99 from the second stripping section 60 of the stripping column 42. A stripped hydrocracked stream may also be recovered with the stripped saturated stream as a joint stripped stream in the bottoms line 98. Light gases stripped from the hydrotreated stream in the first stripper section 58 communicate with light gases stripped from the saturate stream in the second stripper section 60 and may be withdrawn in the same overhead line 48.

A fractionation column 70 fractionates the stripped saturated stream and perhaps the stripped hydrocracked stream to produce a diesel stream in line 94. The product diesel stream may have less than 50 wppm sulfur and preferably less than 10 wppm sulfur. The product diesel stream also will have a cetane number of at least 45 and preferably at least 50. The fractionation column 70 is in downstream communication with the second striping section 60 of the stripping column 42. In an aspect, the fractionation column fractionates a joint stripped stream comprising the hydrocracked stream and the saturated stream together to produce the diesel stream in line 94. An overhead line 72 from the fractionation column 70 may be condensed and deposited in a receiver 74 to yield a naphtha stream 76. A portion of the naphtha stream may be refluxed to the fractionation column 70 and the other portion recovered as product or further processed in line 78. A saturated unconverted oil stream such as VGO may be recovered from a bottom of the fractionation column in bottoms line 100 which may be an excellent feedstock to an FCC unit or a hydrocracking unit.

In the FIGURE, the saturated unconverted oil stream may be fed to the hydrocracking reactor as the hydrocarbon stream in the fractionation bottoms line 100. The hydrocracking reactor 180 may be in downstream communication with the fractionation bottoms line 100 of the fractionation column 70. A fractionated kerosene stream may be recovered from the fractionation column 70 as a side cut in line 92 and a fractionated diesel stream may be recovered from the fractionation column as a side cut in line 94. The fractionation column 70 may be heated by an inert stripping stream such as steam fed through line 93. The top pressure in the fractionator column 70 ranges between about 0 kPa (gauge) (0 psig) and about 206 kPa (gauge) (30 psig) and the bottom temperature in the fractionator column 70 ranges between about 300 and about 350° C.

A first embodiment of the invention is a process to produce diesel comprising hydrotreating a hydrocarbonaceous feedstock with hydrogen in a hydrotreating reactor over a hydrotreating catalyst at conditions effective to produce a hydrotreated stream; stripping light gases from the hydrotreated stream to provide a stripped hydrotreated stream; saturating aromatics in the stripped hydrotreated stream to produce a saturated stream; stripping light gases from the saturated stream to provide a stripped saturated stream and fractionating the stripped saturated stream to produce a diesel stream. An embodiment of the invention is one, any or all of prior embodiments in this paragraph up through the first embodiment in this paragraph, further comprising isolating liquid in the hydrotreated stream from liquid in the saturated stream while stripping light gases from the hydrotreated stream and stripping light gases from the saturated stream. An embodiment of the invention is one, any or all of prior embodiments in this paragraph up through the first embodiment in this paragraph, further comprising stripping light gases from the hydrotreated stream and stripping light gases from the saturated stream in a single stripping column. An embodiment of the invention is one, any or all of prior embodiments in this paragraph up through the first embodiment in this paragraph, wherein the single stripping column includes a dividing wall and the hydrotreated stream is fed to a first side of the dividing wall in the dividing wall column and the saturated stream is fed to a second side of the dividing wall. An embodiment of the invention is one, any or all of prior embodiments in this paragraph up through the first embodiment in this paragraph, further comprising stripping the hydrotreated stream with a first stripping stream and stripping the saturated stream with a second stripping stream that does not communicate with the first stripping stream before the second stripping stream strips the saturate stream. An embodiment of the invention is one, any or all of prior embodiments in this paragraph up through the first embodiment in this paragraph, further comprising hydrotreating the hydrocarbonaceous feed at a pressure of about 9 MPa to about 11 MPa (gauge). An embodiment of the invention is one, any or all of prior embodiments in this paragraph up through the first embodiment in this paragraph, further comprising hydrocracking a hydrocarbon stream with hydrogen in a hydrocracking reactor over a hydrocracking catalyst at conditions effective to produce a hydrocracked stream. An embodiment of the invention is one, any or all of prior embodiments in this paragraph up through the first embodiment in this paragraph further comprising stripping light gases from the hydrocracked stream to produce a stripped hydrocracked stream and fractionating the stripped hydrocracked stream to produce the diesel stream. An embodiment of the invention is one, any or all of prior embodiments in this paragraph up through the first embodiment in this paragraph further comprising stripping light gases from the hydrocracked stream and the saturated stream together to produce a joint stripped stream comprising the stripped saturated stream and the stripped hydrocracked stream and fractionating the joint stripped stream to produce the diesel stream. An embodiment of the invention is one, any or all of prior embodiments in this paragraph up through the first embodiment in this paragraph producing an unconverted oil stream in the fractionation step to provide the hydrocarbon stream.

A second embodiment of the invention is a process to produce diesel comprising hydrotreating a hydrocarbonaceous feedstock with hydrogen in a hydrotreating reactor over a hydrotreating catalyst at conditions effective to produce a hydrotreated stream; stripping light gases from the hydrotreated stream to provide a stripped hydrotreated stream; saturating aromatics in the stripped hydrotreated stream to produce a saturated stream; hydrocracking a hydrocarbon stream with hydrogen in a hydrocracking reactor over a hydrocracking catalyst at conditions effective to produce a hydrocracked stream; and stripping light gases from the saturated stream and the hydrocracked stream to provide a joint stripped stream comprising a stripped saturated stream and a stripped hydrocracked stream. An embodiment of the invention is one, any or all of prior embodiments in this paragraph up through the second embodiment in this paragraph, further comprising fractionating the joint stripped stream to produce a diesel stream. An embodiment of the invention is one, any or all of prior embodiments in this paragraph up through the second embodiment in this paragraph, further comprising isolating liquid in the hydrotreated stream from liquid in the saturated stream and the hydrocracked stream while stripping light gases from the hydrotreated stream and stripping light gases from the saturated stream and the hydrocracked stream. An embodiment of the invention is one, any or all of prior embodiments in this paragraph up through the second embodiment in this paragraph, further comprising stripping light gases from the hydrotreated stream and stripping light gases from the saturated stream and the hydrotreated stream in a single stripping column. An embodiment of the invention is one, any or all of prior embodiments in this paragraph up through the second embodiment in this paragraph, wherein the single stripping column includes a dividing wall and the hydrotreated stream is fed to a first side of the dividing wall in the dividing wall column and the saturated stream is fed to a second side of the dividing wall. An embodiment of the invention is one, any or all of prior embodiments in this paragraph up through the second embodiment in this paragraph, further comprising producing an unconverted oil stream in the fractionation step to provide the hydrocarbon stream. An embodiment of the invention is one, any or all of prior embodiments in this paragraph up through the second embodiment in this paragraph, further comprising stripping the hydrotreated stream with a first stripping stream and stripping the saturated stream and the hydrocracked stream with a second stripping stream that does not communicate with the first stripping stream before the second stripping stream strips the saturate stream and the hydrocracked stream. An embodiment of the invention is one, any or all of prior embodiments in this paragraph up through the second embodiment in this paragraph, wherein light gases stripped from the hydrotreated stream communicate with light gases stripped from the saturate stream and the hydrocracked stream.

A third embodiment of the invention is a process to produce diesel comprising hydrotreating a hydrocarbonaceous feedstock with hydrogen in a hydrotreating reactor over a hydrotreating catalyst at conditions effective to produce a hydrotreated stream; stripping light gases from the hydrotreated stream to provide a stripped hydrotreated stream; saturating aromatics in the stripped hydrotreated stream to produce a saturated stream; hydrocracking a hydrocarbon stream with hydrogen in a hydrocracking reactor over a hydrocracking catalyst at conditions effective to produce a hydrocracked stream; stripping light gases from the saturated stream and the hydrocracked stream to provide a joint stripped stream comprising a stripped saturated stream and a stripped hydrocracked stream; and fractionating the joint stripped stream to produce a diesel stream. An embodiment of the invention is one, any or all of prior embodiments in this paragraph up through the third embodiment in this paragraph, further comprising producing an unconverted oil stream in the fractionation step to provide the hydrocarbon stream.

A fourth embodiment of the invention is an apparatus to produce diesel comprising a hydrotreating reactor for hydrotreating a hydrocarbonaceous feedstock to produce a hydrotreated stream; a first stripping section in communication with the hydrotreating reactor for stripping light gases from the hydrotreated stream; a saturation reactor in communication with the first stripping section for saturating aromatics; a second stripping section in communication with the saturation reactor for stripping light gases from a saturated stream; and a fractionation column in communication with the second stripping section. An embodiment of the invention is one, any or all of prior embodiments in this paragraph up through the fourth embodiment in this paragraph, wherein the first stripping section and the second stripping section are in a single stripping column. An embodiment of the invention is one, any or all of prior embodiments in this paragraph up through the fourth embodiment in this paragraph, wherein the first stripping section is separated from the second stripping section by a dividing wall in the stripping column. An embodiment of the invention is one, any or all of prior embodiments in this paragraph up through the fourth embodiment in this paragraph, wherein the dividing wall has a lower end attached to a bottom of the stripping column and the dividing wall has an upper end that is spaced apart from a top of the stripping column. An embodiment of the invention is one, any or all of prior embodiments in this paragraph up through the fourth embodiment in this paragraph, further comprising a hydrotreated stream inlet and a first stripping stream inlet in the first stripping section and a saturated stream inlet and a second stripping stream inlet in the second stripping section. An embodiment of the invention is one, any or all of prior embodiments in this paragraph up through the fourth embodiment in this paragraph, further comprising a single overhead line from the stripping column. An embodiment of the invention is one, any or all of prior embodiments in this paragraph up through the fourth embodiment in this paragraph, wherein the saturation reactor is in communication with the first stripping section. An embodiment of the invention is one, any or all of prior embodiments in this paragraph up through the fourth embodiment in this paragraph wherein the fractionation column in communication with the second stripping section. An embodiment of the invention is one, any or all of prior embodiments in this paragraph up through the fourth embodiment in this paragraph further comprising a hydrocracking reactor in communication with the fractionation column. An embodiment of the invention is one, any or all of prior embodiments in this paragraph up through the fourth embodiment in this paragraph wherein the second stripping section is in communication with the hydrocracking reactor.

A fifth embodiment of the invention is an apparatus to produce diesel comprising a hydrotreating reactor for hydrotreating a hydrocarbonaceous feedstock to produce a hydrotreated stream; a first stripping section in communication with the hydrotreating reactor for stripping light gases from the hydrotreated stream; a saturation reactor in communication with the stripping column for saturating aromatics; a second stripping section in communication with the saturation reactor for stripping light gases from a saturated stream; and a hydrocracking reactor in communication with the stripping column. An embodiment of the invention is one, any or all of prior embodiments in this paragraph up through the fifth embodiment in this paragraph, wherein the first stripping section and the second stripping section are in a single stripping column. An embodiment of the invention is one, any or all of prior embodiments in this paragraph up through the fifth embodiment in this paragraph, wherein the first stripping section is separated from the second stripping section by a dividing wall in the stripping column; the dividing wall having a lower end attached to a bottom of the stripping column and the dividing wall has an upper end that is spaced apart from the top of the stripping column. An embodiment of the invention is one, any or all of prior embodiments in this paragraph up through the fifth embodiment in this paragraph, wherein the saturation reactor is in communication with the first stripping section and the hydrocracking reactor is in communication with the second stripping section. An embodiment of the invention is one, any or all of prior embodiments in this paragraph up through the fifth embodiment in this paragraph further comprising a fractionation column in communication with the second stripping section and the hydrocracking reactor in communication with the fractionation column. An embodiment of the invention is one, any or all of prior embodiments in this paragraph up through the fifth embodiment in this paragraph wherein the second stripping section is in downstream communication with the hydrocracking reactor and the saturation reactor.

A sixth embodiment of the invention is an apparatus to produce diesel comprising a hydrotreating reactor for hydrotreating a hydrocarbonaceous feedstock to produce a hydrotreated stream; a first stripping section in communication with the hydrotreating reactor for stripping light gases from the hydrotreated stream; a saturation reactor in communication with the stripping column for saturating aromatics; a second stripping section in communication with the saturation reactor for stripping light gases from a saturated stream; a fractionation column in communication with the stripping column; and a hydrocracking reactor in communication with the fractionation column. An embodiment of the invention is one, any or all of prior embodiments in this paragraph up through the sixth embodiment in this paragraph, wherein the first stripping section and the second stripping section are in a single stripping column and the first stripping section is separated from the second stripping section by a dividing wall in the stripping column. An embodiment of the invention is one, any or all of prior embodiments in this paragraph up through the sixth embodiment in this paragraph, wherein the dividing wall has a lower end attached to a bottom of the stripping column and the dividing wall has an upper end that is spaced apart from the top of the stripping column. An embodiment of the invention is one, any or all of prior embodiments in this paragraph up through the sixth embodiment in this paragraph wherein the second stripping section is in downstream communication with the hydrocracking reactor and the saturation reactor.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An apparatus to produce diesel comprising:

a hydrotreating reactor in which a hydrocarbonaceous feedstock is hydrotreated to produce a hydrotreated stream;

a first stripping section comprising a column and a first stripping stream inlet, said first stripping section in communication with said hydrotreating reactor in which light gases are stripped from said hydrotreated stream;

a saturation reactor in communication with said first stripping section in which aromatics are saturated;

a second stripping section comprising a column and a second stripping stream inlet, said second stripping section in communication with said saturation reactor in which light gases are stripped from a saturated stream;

a fractionation column in communication with said second stripping section wherein a diesel stream and a bottoms stream are separately recovered from the fractionation column; and wherein the fractionation column is in downstream communication with the second stripping section.

2. The apparatus of claim 1, wherein said first stripping section and said second stripping section are in a single stripping column.

3. The apparatus of claim 2, wherein said first stripping section is separated from said second stripping section by a dividing wall in said stripping column.

4. The apparatus of claim 3, wherein said dividing wall has a lower end attached to a bottom of the stripping column and the dividing wall has an upper end that is spaced apart from a top of the stripping column.

5. The apparatus of claim 2, further comprising a hydrotreated stream inlet and a first stripping stream inlet in the first stripping section and a saturated stream inlet and a second stripping stream inlet in the second stripping section.

6. The apparatus of claim 5, further comprising a single overhead line from the stripping column.

7. The apparatus of claim 1, wherein said saturation reactor is in downstream communication with said first stripping section.

8. The apparatus of claim 7 wherein said fractionation column is in downstream communication with said second stripping section.

9. The apparatus of claim 1 further comprising a hydrocracking reactor in communication with said fractionation column.

10. The apparatus of claim 9 wherein said second stripping section is in communication with said hydrocracking reactor.

11. An apparatus to produce diesel comprising:

a hydrotreating reactor for hydrotreating a hydrocarbonaceous feedstock to produce a hydrotreated stream;

a first stripping section comprising a column and a first stripping stream inlet, said first stripping section in communication with said hydrotreating reactor for stripping light gases from said hydrotreated stream;

a saturation reactor in communication with said first stripping section for saturating aromatics;

a second stripping section comprising a column and a second stripping stream inlet, said second stripping section in communication with said saturation reactor for stripping light gases from a saturated stream;

a hydrocracking reactor in upstream communication with said second stripping Section; and a fractionation column is in downstream communication with a bottom line from a separator which is in downstream communication with the hydrocracking reactor.

12. The apparatus of claim 11, wherein said first stripping section and said second stripping section are in a single stripping column.

13. The apparatus of claim 12, wherein said first stripping section is separated from said second stripping section by a dividing wall in said stripping column; said dividing wall having a lower end attached to a bottom of the stripping column and the dividing wall has an upper end that is spaced apart from the top of the stripping column.

14. The apparatus of claim 11, wherein said saturation reactor is in downstream communication with said first stripping section.

15. The apparatus of claim 14 further comprising the fractionation column in communication with said second stripping section and said hydrocracking reactor in communication with said fractionation column.

16. The apparatus of claim 15 wherein said second stripping section is in downstream communication with said hydrocracking reactor and said saturation reactor.

17. An apparatus to produce diesel comprising:

a hydrotreating reactor for hydrotreating a hydrocarbonaceous feedstock to produce a hydrotreated stream;

a first stripping section in communication with said hydrotreating reactor for stripping light gases from said hydrotreated stream;

a saturation reactor in communication with said first stripping section for saturating aromatics;

a second stripping section in communication with said saturation reactor for stripping light gases from a saturated stream;

a fractionation column in communication with said second stripping section; and a hydrocracking reactor in communication with said fractionation column, wherein said first stripping section and said second stripping section are in a single stripping column and said first stripping section is separated from said second stripping section by a dividing wall in said stripping column, wherein said second stripping section is in downstream communication with said hydrocracking reactor and said saturation reactor.

18. The apparatus of claim 17, wherein said dividing wall has a lower end attached to a bottom of the stripping column and the dividing wall has an upper end that is spaced apart from the top of the stripping column.

* * * * *